US007918948B2

(12) United States Patent
Fukunaga et al.

(10) Patent No.: US 7,918,948 B2
(45) Date of Patent: Apr. 5, 2011

(54) METHOD OF PRODUCTION OF 780 MPA CLASS HIGH STRENGTH STEEL PLATE EXCELLENT IN LOW TEMPERATURE TOUGHNESS

(75) Inventors: Kazuhiro Fukunaga, Tokyo (JP); Ryuji Uemori, Tokyo (JP); Yoshiyuki Watanabe, Tokyo (JP); Yoshihide Nagai, Tokyo (JP); Rikio Chijiiwa, Kawasaki (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/734,103

(22) PCT Filed: Apr. 3, 2009

(86) PCT No.: PCT/JP2009/057295

§ 371 (c)(1),
(2), (4) Date: Apr. 9, 2010

(87) PCT Pub. No.: WO2009/125820

PCT Pub. Date: Oct. 15, 2009

(65) Prior Publication Data

US 2010/0206440 A1 Aug. 19, 2010

(30) Foreign Application Priority Data

Apr. 9, 2008 (JP) ..... 2008-101959
Mar. 13, 2009 (JP) ..... 2009-061114

(51) Int. Cl.
*C21D 8/02* (2006.01)

(52) U.S. Cl. ..... 148/653; 148/654; 148/663; 148/506; 148/505

(58) Field of Classification Search ..... 148/330, 148/335, 653, 654, 663, 320, 506, 505; 420/106, 420/109

See application file for complete search history.

(56) References Cited

FOREIGN PATENT DOCUMENTS

| | | |
|---|---|---|
| JP | 3-44417 | 2/1991 |
| JP | 5-9570 | 1/1993 |
| JP | 06-240355 | 8/1994 |
| JP | 2000-008135 | 1/2000 |
| JP | 2007-138203 | 6/2007 |
| JP | 2007-146220 | 6/2007 |

OTHER PUBLICATIONS

Machine-English translation of Japanese patent 08-283899, Tokuno Kazunari et al., Oct. 29, 1996.*
International Search Report dated Jul. 21, 2009 issued in corresponding PCT Application No. PCT/JP2009/057295.

* cited by examiner

*Primary Examiner* — Deborah Yee
(74) *Attorney, Agent, or Firm* — Kenyon & Kenyon LLP

(57) ABSTRACT

A method of production of 780 MPa class high strength steel plate excellent low temperature toughness comprising heating a steel slab of containing, by mass %, C: 0.06 to 0.15%, Si: 0.05 to 0.35%, Mn: 0.60 to 2.00%, P: 0.015% or less, S: 0.015% or less, Cu: 0.1 to 0.5%, Ni: 0.1 to 1.5%, Cr: 0.05 to 0.8%, Mo: 0.05 to 0.6%, Nb: less than 0.005%, V: 0.005 to 0.060%, Ti: less than 0.003%, Al: 0.02 to 0.10%, B: 0.0005 to 0.003%, and N: 0.002 to 0.006% to 1050° C. to 1200° C. in temperature, hot rolling ending at 870° C. or more, waiting for 10 seconds to 90 seconds, then cooling from 840° C. or more in temperature by a 5° C./s or more cooling rate to 200° C., then tempering at 450° C. to 650° C. in temperature for 20 minutes to 60 minutes.

2 Claims, No Drawings

METHOD OF PRODUCTION OF 780 MPA CLASS HIGH STRENGTH STEEL PLATE EXCELLENT IN LOW TEMPERATURE TOUGHNESS

This application is a national stage application of International Application No. PCT/JP2009/057295, filed 3 Apr. 2009, which claims priority to Japanese Application Nos. 2008-101959, filed 9 Apr. 2008; and 2009-061114, filed 13 Mar. 2009, each of which is incorporated by reference in its entirety.

TECHNICAL FIELD

The present invention relates to a method of production of excellent low temperature toughness and 780 MPa class high strength steel plate for offshore structures and penstocks etc.

BACKGROUND ART

To produce a steel plate having a tensile strength of the 780 MPa class and having excellent low temperature toughness, refinement of the quenched structure (lower bainite or martensite) is said to be effective. To refine a quenched structure, it is necessary to refine the austenite grain size before the formation of the quenched structure before cooling the steel material.

In particular, when producing a plate by direct quenching (DQ), controlled rolling may be used to control the austenite grain size. By rolling in the austenite recrystallization region, refinement of the austenite grain size before the formation of the quenched structure becomes possible.

However, it is difficult to obtain a grasp of the austenite recrystallization region and pre-recrystallization region of austenite of a steel before rolling. Variation in the austenite grains is liable to invite instability in the quality of steel.

On the other hand, by making maximum use of controlled rolling and refining the structure, excellent low temperature toughness should be able to be secured. For example, Japanese Patent Publication (A) No. 6-240355 discloses performing final rolling of a steel plate containing Nb at the pre-recrystallization region of austenite of 780° C. or less so as to achieve refinement of structure of thick-gauge steel plate and secure excellent low temperature toughness at the center of plate thickness.

However, with this method of production, the quenchability greatly falls and a ferrite structure is mainly formed, so it is difficult to secure a 780 MPa class high strength and high toughness. Furthermore, rolling at a low temperature becomes necessary, so there is also a problem from the viewpoint of the productivity.

Further, the Nb added for refining the structure is extremely high in effect of hardening the welding heat affected zone (HAZ). As a result, it causes deterioration of the HAZ toughness. In particular, with high strength steel such as the 780 MPa class steel, the deterioration in HAZ toughness due to this effect becomes an extremely great problem.

To obtain a 780 MPa class strength, it is effective to add B having a large effect in raising the quenchability. However, as described in Japanese Patent Publication (A) No. 2007-138203, B promotes the formation of a hardened second phase due to the simultaneous addition of Nb. The deterioration of the HAZ toughness became a particular problem as a result.

To improve the HAZ toughness, it is known that addition of Ti is effective. This is because Ti bonds with N etc. to form fine precipitates and has the effect of restraining grain growth.

However, as described in Japanese Patent Publication (A) No. 2000-8135, in the case of steel containing C in 0.2% or more for the purpose of securing the strength, extremely hard grains of TiC are formed at the base metal and HAZ. This has the problem of causing a deterioration of toughness.

In the above way, up to now, the fact is that no method of production of 780 MPa class high strength steel plate free of Nb, free of Ti, and provided with both high strength and excellent low temperature toughness has yet been proposed.

DISCLOSURE OF INVENTION

The present invention, in view of the above situation, provides a method of production of 780 MPa class high strength steel plate excellent in low temperature toughness suitable for thick-gauge steel plate for offshore structures and penstocks etc. which is Nb-free, is Ti-free, and is provided with both high strength and excellent low temperature toughness even at the center part of the plate thickness of the 780 MPa class high strength steel plate.

The inventors, to solve the above problems, rolled steel not containing Nb or Ti for refining the austenite grain size under suitable rolling conditions. As a result, they discovered that by making maximum use of the effect of improvement of quenchability of B to obtain a quenched structure and making the microstructure finer, it is possible to obtain both high strength and high toughness and that by making the steel Nb and Ti free, it becomes possible to avoid deterioration of toughness due to these, and therefore it becomes possible to produce 780 MPa class high strength steel plate stably securing high strength and excellent low temperature toughness even at the center part of plate thickness and thereby completed the present invention.

The gist of the present invention is as follows:

(1) A method of production of 780 MPa class high strength steel plate excellent in low temperature toughness characterized by heating a steel slab of chemical compositions containing, by mass %, C: 0.06 to 0.15%,
Si: 0.05 to 0.35%,
Mn: 0.60 to 2.00%,
P: 0.015% or less,
S: 0.015% or less,
Cu: 0.1 to 0.5%,
Ni: 0.1 to 1.5%,
Cr: 0.05 to 0.8%,
Mo: 0.05 to 0.6%,
Nb: less than 0.005%,
V: 0.005 to 0.060%,
Ti: less than 0.003%,
Al: 0.02 to 0.10%,
B: 0.0005 to 0.003%, and
N: 0.002 to 0.006%, having a balance of iron and unavoidable impurities, and having a BNP defined by $$BNP=(N-(14/48)Ti)/B$$

of over 1.5 to less than 4.0, to 1050° C. to 1200° C. in temperature, hot rolling ending at 870° C. or more, waiting for 10 seconds to 90 seconds, then cooling from 840° C. or more in temperature by a 5° C./s or more cooling rate to 200° C., then tempering at 450° C. to 650° C. in temperature for 20 minutes to 60 minutes (2) A method of production of 780 MPa class high strength steel plate excellent in low temperature toughness as set forth in (1) characterized in that said steel slab further contains, by mass %, one or more of Ca: 0.0035% or less and REM: 0.0040% or less.

BEST MODE FOR CARRYING OUT THE INVENTION

Below, embodiments of the present invention will be explained.

The present invention makes the steel Nb-free and Ti-free to avoid the excessive refinement of the old austenite grain size and makes maximum use of B to secure quenchability so can stably secure high strength and high low temperature toughness even at the center part of plate thickness.

In a steel material suitable for steel plate etc. for offshore structures, penstocks, etc. covered by the present invention, a 780 MPa class high strength and toughness of the base material and HAZ at −40° C. are demanded. To secure a high strength, it is necessary to increase the Nb, Ti, and other alloy elements and water cool the steel to obtain a quenched structure such as a lower bainite structure and martensite structure, but if the contents of the alloy elements are high, it is difficult to secure toughness. In particular, securing low temperature HAZ toughness becomes a problem.

To achieve both a high strength and low temperature HAZ toughness, it is necessary to secure strength without using expensive alloy elements as much as possible. As one proposal for solving this, there is use of B. This has been practiced in the past.

It is known that B segregates at the austenite grain boundaries and stabilizes the grain boundaries, so suppresses transformation from the grain boundaries, increases the quenchability, and, in particular when the amount of solid solution B becomes 0.0005% or more, gives the effect of a high improvement in quenchability. For this reason, there was the problem that if making extensive use of controlled rolling, the austenite grains became finer and the austenite grain boundary area increased resulting in an insufficient amount of segregation of solid solution B at the grain boundaries and a large amount of dislocations were introduced into the austenite resulting in promotion of pipe diffusion and the difficult of segregation of solid solution B at the austenite grain boundaries as a result of which the predetermined quenchability could not be obtained and the material quality varied. In addition, B is an element exhibiting its effects in fine amounts, so reacts sensitively with fine differences in conditions. Therefore, to stably make use of B, it is effective not to make the austenite grains finer and not to introduce large amounts of dislocations.

The inventors discovered that by rolling steel under suitable rolling conditions without adding Nb or Ti for refining the austenite grain size and as a result making maximum use of the effect of improvement of quenchability by B to obtain a quenched structure and refine the lower structure, it is possible to achieve both a high strength and high toughness. Furthermore, by making the steel Nb- and Ti-free, it becomes possible to avoid deterioration of toughness due to the same. Further, the inventors discovered that by rolling under suitable rolling conditions and securing an austenite grain size of 50 μm or more, it is possible to cause the solid solution B required for securing quenchability to segregate in a sufficient amount at the austenite grain boundaries. Note that, to secure a 780 MPa class strength, in addition to securing the quenchability by B, it is necessary to make the carbon equivalent (Ceq) expressed by the following formula (1) 0.41 to 0.61. The lower limit may be set to 0.42% and the upper limit to 0.54%.

$$Ceq = \%C + \%Mn/6 + (\%Cu + \%Ni)/15 + (\%Cr + \%Mo + \%V)/5 \quad \text{formula (1)}$$

Below, the reasons for limitation of the present invention will be explained. First, the reasons for limitation of the composition of the steel material of the present invention will be explained. The % in the following compositions means mass %.

C: 0.06 to 0.15%

C is an element necessary for securing strength. 0.06% or more has to be added, but addition of a large amount is liable to invite a deterioration of low temperature toughness, in particular a deterioration of the HAZ toughness, so the upper limit is made 0.15%. Preferably, the lower limit is set to 0.08% or 0.09% and the upper limit is set to 0.12% or 0.11%.

Si: 0.05 to 0.35%

Si is an element effective as a deoxidizing element or for increasing the strength of the steel by solution strengthening, but with less than a 0.05% content, these effects are small, while if over 0.35% is included, the HAZ toughness is degraded. For this reason, Si was limited to 0.05 to 0.35%. Preferably, the lower limit is set to 0.10% and the upper limit is set to 0.30% or 0.25%.

Mn: 0.60 to 2.00%

Mn is an element effective for increasing the strength for raising the strength of the steel. From the viewpoint of securing the quenchability, a 0.60% or more content is necessary. However, if adding over 2.00% of Mn, the toughness deteriorates. For this reason, Mn was limited to 0.60 to 2.00%. Preferably, the lower limit is set to 0.70% or 0.80% and the upper limit is set to 1.20% or 1.00%.

P: 0.015% or less

P segregates at the grain boundaries to degrade the toughness of the steel, so should be reduced as much as possible, but up to 0.015% is allowable, so the content was limited to 0.015% or less. Preferably, the upper limit is set to 0.010% or 0.008%.

S: 0.015% or less

S mainly forms MnS and remains in the steel and has the action of making the structure finer after rolling and cooling, but a content of 0.015% or more reduces the toughness and ductility in the plate thickness direction. To avoid this, S has to be 0.015% or less, so S was limited to 0.015% or less. Preferably, the upper limit is set to 0.010%, 0.006%, or 0.003%.

Cu: 0.1 to 0.5%

Cu is an element effective for securing the strength of steel plate by solution strengthening and precipitation strengthening. A content of 0.10% or more is necessary, but addition of 0.50% or more is liable to reduce the hot workability. For this reason, Cu was limited to 0.1 to 0.5%. Preferably, the lower limit is set to 0.15% and the upper limit is set to 0.3%.

Ni: 0.1 to 1.5%

Ni is effective for securing the strength and low temperature toughness of the steel plate. A content of 0.10% or more is necessary. However, this is an extremely expensive element, so addition of 1.50% or more invites a great increase in costs. For this reason, Ni was limited to 0.1 to 1.5%. Preferably, the lower limit is set to 0.25%, and the upper limit is set to 1.2%, more preferably the lower limit is set to 0.65% and the upper limit is set to 0.95%.

Cr: 0.05 to 0.8%

Cr is an element effective for securing the strength of the steel plate mainly by solution strengthening. A content of 0.05% or more is necessary, but addition of 0.8% or more impairs the workability and weldability of the steel plate and invites a rise in costs. For this reason, Cr was limited to 0.05 to 0.8%. Preferably, the lower limit is set to 0.20% or 0.30% and the upper limit is set to 0.60% or 0.45%.

Mo: 0.05 to 0.6%

Mo is an element effective for securing the strength of the steel plate by precipitation strengthening or solution strengthening. A content of 0.05% or more is necessary, but addition of 0.60% or more detracts from the workability of the steel plate and greatly increases the cost. For this reason, Mo was limited to 0.05 to 0.6%. Preferably, the lower limit is set to 0.25 or 0.30% and the upper limit is set to 0.50% or 0.45%.

Nb: less than 0.005%

Nb enlarges the pre-recrystallization region of austenite and promotes the increased fineness of the grains of ferrite, so invites a drop in the quenchability. Further, the Nb carbides result in easier HAZ embrittlement, so this is preferably not included as much as possible. However, 0.005% is allowable, so Nb was limited to less than 0.005%. The content is preferably 0.003% or less, more preferably 0.002% or less.

V: 0.005 to 0.060%

V is an element effective for securing the strength of steel plate by precipitation strengthening. A content of 0.005% or more is necessary, but addition of 0.060% or more impairs the weldability and toughness of the steel plate, so V was limited to 0.005 to 0.060%. Preferably, the lower limit is set at 0.025% or 0.035% and the upper limit is set at 0.050%.

Ti: less than 0.003%

Ti bonds with C to form TiC and is thereby liable to degrade the base material toughness. In particular, this is remarkable in a 780 MPa class strength steel material, so this element is preferably not contained much at all. However, less than 0.003% is allowable, so Ti was limited to less than 0.003%. The content is preferably 0.002% or less.

Al: 0.02 to 0.10%

Al bonds with N to form AlN and thereby has the effect of avoiding rapid coarsening of the austenite grain size at the time of reheating, so addition of 0.02% or more is necessary, but addition of 0.10% is liable to form coarse inclusions and degrade the toughness. For this reason, Al was limited to 0.02 to 0.10%. To improve the strength and toughness of the center part of plate thickness, preferably the content is 0.04 to 0.08%, more preferably 0.05% to 0.08% or 0.06 to 0.08%.

B: 0.0005 to 0.003%

B is an element required for securing quenchability. To secure the amount of solid solution B of 0.0005% required to obtain a sufficient effect of improvement of the quenchability at the center part of the plate thickness, addition of 0.0005% or more is necessary. However, with addition of 0.003% or more, due to the excessive B, the quenchability excessively rises. Due to this, the toughness becomes low. Further, the excessive B forms coarse nitrides which are liable to degrade the toughness. For this reason, B was limited to 0.0005 to 0.003%. To improve the strength and toughness at the center part of the plate thickness, the content is preferably 0.0005 to 0.002% or 0.0005 to 0.0015%.

N: 0.002 to 0.006%

N bonds with Al to form AlN and thereby has the effect of avoiding rapid coarsening of the austenite grain size at the time of reheating, but addition of 0.006% or more is liable to result in bonding with B and reduction of the amount of solid solution B inviting a drop in quenchability. For this reason, N was limited to 0.002 to 0.006%. Preferably, the lower limit is set to 0.002% and the upper limit to 0.004%.

BNP: over 1.5 to less than 4.0

BNP is a parameter shown by the following formula (2) for finding the balance of Ti, N, and B required for securing the quenchability. With 1.5 or less, B becomes excessive and invites a deterioration of toughness, while with 4.0 or more, the insufficient solid solution B causes sufficient quenchability to be unable to be obtained. For this reason, BNP was limited to over 1.5 to less than 4.0. To improve the strength and toughness of the center part of the steel plate, preferably the lower limit is set to 1.8, 2.0 or more and the upper limit is set to 3.6, 3.2 or 2.8.

$$BNP=(N-(14/48)Ti)/B \quad (2)$$

The above are essential elements in the present invention. Addition of the following elements is also effective in a range not detracting from these effects.

Addition of one or both of Ca: 0.0035% or less and REM: 0.0040% or less.

By addition of Ca, the form of the MnS is controlled and the low temperature toughness is further improved, so this can be selectively added when strict HAZ characteristics are required. Furthermore, an REM enables formation of fine oxides and fine sulfides in the molten steel and their stable presence later as well, so act effectively as pinning particles in the HAZ and in particularly have an action of improving the large heat input weld toughness, so can be selectively added when particularly excellent toughness is required.

On the other hand, with addition of Ca over 0.0035%, the cleanliness of the steel is impaired and the toughness is degraded and susceptibility to hydrogen induced cracking ends up being raised, therefore 0.0035% was made the upper limit. If the REM is added over 0.0040%, the precipitates become excessive and are liable to cause reduction of area at the time of casting, so 0.0040% was made the upper limit.

Next, the reasons for limitation of the production conditions of the invention steels will be explained.

Regarding the heating temperature, it is required to be a temperature of 1050° C. to 1200° C. With heating of less than 1050° C., there is a possibility of coarse inclusions having a detrimental effect on the toughness formed during the solidification remaining without being melted. Further, if heating at a high temperature, there is a possibility of precipitates formed by controlling the cooling rate during casting ending up being remelted. If based on the above, as the heating temperature for ending the phase transformation, 1200° C. or less is sufficient. Coarsening of the crystal grains considered to occur at this time can be prevented in advance. Due to the above, the heating temperature was limited to 1050° C. to 1200° C. It is preferably 1050° C. to 1150° C.

It is necessary to end the hot rolling at 870° C. or more. As the reason, when rolling at less than 870° C., the rolling is performed at the recrystallization temperature and pre-recrystallization temperature of austenite and the material quality will become unstable due to the variation in austenite grain size or the rolling is performed completely at the pre-recrystallization region and the austenite grain size is refined to 50 μm or less, so the solid solution B for segregation at the austenite grain boundaries is liable to become insufficient and as a result the quenchability will drop and the required strength will no longer be able to be obtained. For this reason, the hot rolling is ended at 870° C. or more. Preferably, the hot rolling is ended at 880° C. or more.

After 10 seconds to 90 seconds from the end of hot rolling, the steel slab has to be cooled from 840° C. or more temperature by a 5° C./s or more cooling rate down to 200° C. If less than 10 seconds, the B does not sufficiently disperse to the austenite grain boundaries, while if over 90 seconds, the B bonds with the N in the steel, so the quenchability drops and the required strength can no longer be obtained. Further, if starting cooling at less than 840° C., this is disadvantageous from the viewpoint of the quenchability. There is a possibility that the required strength cannot be obtained. Further, with a cooling rate of less than 5° C./s, the uniform lower bainite structure or uniform martensite structure required for obtaining the required strength cannot be uniformly obtained. Further, if stopping the cooling at over a 200° C. temperature, the lower bainite structure or lower structure at the martensite structure (packets, blocks, etc.) become coarser, so strength and toughness becomes difficult to secure. For the above reasons, the invention is limited to cooling the steel slab from a 840° C. or more temperature by a 5° C./s or more cooling rate down to 200° C. after 10 seconds to 90 seconds after finishing the hot rolling. Preferably, the cooling is performed from 860° C. or more temperature.

After finishing hot rolling the steel slab and cooling it, the slat has to be tempered at a 450° C. to 650° C. temperature for 20 minutes to 60 minutes. When tempering, the higher the tempering temperature, the greater the drop in strength. If exceeding 650° C., this becomes remarkable, so the required strength can no longer be obtained. Further, with less than 450° C. tempering, the toughness improving effect cannot be sufficiently obtained. On the other hand, if the tempering time is less than 20 minutes, the toughness improving effect is not sufficiently obtained. With tempering over 60 minutes, there is no remarkable change in material quality. Along with the increase in heat treatment time, the cost rises and a drop in productivity is invited. For the above reasons, the invention is limited to tempering at 450° C. to 650° C. of temperature for 20 minutes to 60 minutes after finishing the hot rolling of the steel slab and cooling it.

EXAMPLES

Next, examples of the present invention will be explained.

Steel slabs having the chemical compositions of Table 1 were hot rolled and tempered under the conditions shown in Table 2 and Table 3 to form steel plates, then were tested for evaluation of the mechanical properties. For the tensile test pieces, JIS No. 4 test pieces were taken from the ¼ and ½ locations of plate thickness of the steel plates and were evaluated for YS (0.2% yield strength), TS, and El. The base material toughness was evaluated by taking JIS 2 mm V-notch test pieces from locations of ¼ to ½ of the plate thickness of the different steel plates, running Charpy impact tests at −40° C., and obtaining the impact absorption energy values. Further, the HAZ toughness was evaluated by heat cycle tests correspond to a welding heat input of 5 kJ/mm and testing the obtained steel materials by a −40° C. Charpy impact test to obtain the impact absorption energy values. Note that, the base material impact test energy value is preferably an average value of 100 J or more and the HAZ impact test energy value is preferably an average value of 50 J or more.

Table 4 and Table 5 show mechanical properties of the different steels all together. The Steels 1 to 25a show steel plates of examples of the present invention. As clear from Tables 1, 2, and 3, these steel plates satisfy the different requirements of the chemical compositions and production conditions. As shown in Table 4, it is learned that the base material characteristics and the HAZ toughness are excellent. Further, if in the prescribed range, it is learned that even if adding Ca and REM, good mechanical characteristics can be obtained.

On the other hand, the Steels 1 to 25b, as clear from Tables 1, 2, and 3, satisfy the chemical compositions, but are outside the present invention in production conditions. These steels differ from the invention, as shown in Table 4, in their reheating temperatures (Steel 5b, Steel 18b, and Steel 20b), rolling end temperatures (Steel 8b, Steel 11b, and Steel 22b), elapsed times from rolling end to cooling start (Steel 1b, Steel 10b, Steel 15b, and Steel 24b), cooling start temperatures (Steel 2b, Steel 12b, and Steel 13b), cooling rates (Steel 7b, Steel 9b, Steel 14b, and Steel 23b), cooling stop temperatures (Steel 3b, Steel 19b, and Steel 21b), tempering temperatures (Steel 4b, Steel 6b, and Steel 25b), tempering times (Steel 16b and Steel 17b), so the strengths or HAZ low temperature toughnesses are inferior.

Further, the Steels 26 to 45, as clear from Table 1, show comparative examples with chemical compositions outside the present invention. These steels, as shown in Table 5, differ from the inventions in the conditions of the amount of C (Steel 39), the amount of Si (Steel 37), the amount of Mn (Steel 31), the amount of Cu (Steel 27), the amount of Ni (Steel 33), the amount of Cr (Steel 41), the amount of Mo (Steel 26), the amount of Nb (Steel 29, Steel 43), the amount of V (Steel 30), the amount of Ti (Steel 34, Steel 44), the amount of Al (Steel 36, Steel 45), the amount of B (Steel 35), the amount of N (Steel 40), the BNPs (Steel 28, Steel 42), the amount of Ca (Steel 32), and the amount of REM (Steel 38), so their mechanical properties, in particular the low temperature toughness (base metal and HAZ), are inferior.

TABLE 1

| | | Chemical compositions (mass %) | | | | | | | | | |
|---|---|---|---|---|---|---|---|---|---|---|---|
| | | C | Si | Mn | P | S | Cu | Ni | Cr | Mo | Nb |
| INV. STEEL | 1 | 0.09 | 0.10 | 0.65 | 0.007 | 0.002 | 0.48 | 1.00 | 0.35 | 0.26 | 0.002 |
| | 2 | 0.11 | 0.24 | 0.94 | 0.009 | 0.001 | 0.18 | 0.82 | 0.43 | 0.32 | 0.001 |
| | 3 | 0.08 | 0.22 | 0.86 | 0.006 | 0.002 | 0.22 | 0.69 | 0.40 | 0.50 | 0.001 |
| | 4 | 0.09 | 0.23 | 0.83 | 0.008 | 0.002 | 0.21 | 0.74 | 0.32 | 0.35 | 0.003 |
| | 5 | 0.09 | 0.18 | 0.92 | 0.008 | 0.003 | 0.18 | 0.72 | 0.36 | 0.34 | 0.002 |
| | 6 | 0.10 | 0.21 | 1.97 | 0.007 | 0.002 | 0.13 | 0.25 | 0.41 | 0.32 | 0.002 |
| | 7 | 0.08 | 0.19 | 0.86 | 0.009 | 0.001 | 0.24 | 0.65 | 0.38 | 0.29 | 0.001 |
| | 8 | 0.09 | 0.15 | 0.94 | 0.007 | 0.002 | 0.18 | 0.85 | 0.33 | 0.31 | 0.002 |
| | 9 | 0.06 | 0.20 | 1.19 | 0.006 | 0.001 | 0.22 | 0.77 | 0.36 | 0.38 | 0.001 |
| | 10 | 0.09 | 0.23 | 0.79 | 0.009 | 0.002 | 0.24 | 0.79 | 0.31 | 0.31 | 0.001 |
| | 11 | 0.10 | 0.19 | 0.82 | 0.010 | 0.001 | 0.21 | 0.81 | 0.49 | 0.05 | 0.001 |
| | 12 | 0.10 | 0.22 | 0.61 | 0.008 | 0.002 | 0.16 | 0.83 | 0.44 | 0.29 | 0.002 |
| | 13 | 0.08 | 0.22 | 0.95 | 0.007 | 0.003 | 0.23 | 0.76 | 0.39 | 0.31 | 0.001 |
| | 14 | 0.15 | 0.19 | 0.83 | 0.009 | 0.002 | 0.18 | 0.84 | 0.43 | 0.28 | 0.002 |
| | 15 | 0.09 | 0.15 | 0.86 | 0.008 | 0.001 | 0.21 | 0.82 | 0.46 | 0.33 | 0.001 |
| | 16 | 0.08 | 0.12 | 0.93 | 0.007 | 0.003 | 0.25 | 0.76 | 0.37 | 0.27 | 0.001 |

TABLE 1-continued

| | | | | | | | | | | | |
|---|---|---|---|---|---|---|---|---|---|---|---|
| | 17 | 0.07 | 0.16 | 1.86 | 0.009 | 0.002 | 0.11 | 0.12 | 0.34 | 0.36 | 0.002 |
| | 18 | 0.11 | 0.23 | 0.78 | 0.010 | 0.002 | 0.15 | 0.79 | 0.46 | 0.32 | 0.002 |
| | 19 | 0.09 | 0.27 | 0.83 | 0.006 | 0.003 | 0.22 | 0.83 | 0.06 | 0.48 | 0.002 |
| | 20 | 0.08 | 0.21 | 0.88 | 0.007 | 0.002 | 0.22 | 0.81 | 0.41 | 0.31 | 0.002 |
| | 21 | 0.09 | 0.14 | 0.91 | 0.009 | 0.001 | 0.17 | 0.78 | 0.38 | 0.39 | 0.002 |
| | 22 | 0.08 | 0.33 | 0.82 | 0.006 | 0.002 | 0.23 | 0.87 | 0.43 | 0.28 | 0.004 |
| | 23 | 0.08 | 0.22 | 0.81 | 0.006 | 0.002 | 0.25 | 1.48 | 0.34 | 0.27 | 0.001 |
| | 24 | 0.09 | 0.20 | 0.83 | 0.007 | 0.002 | 0.22 | 0.72 | 0.79 | 0.26 | 0.002 |
| | 25 | 0.08 | 0.18 | 0.78 | 0.006 | 0.001 | 0.18 | 0.67 | 0.32 | 0.58 | 0.001 |
| COMP. STEEL | 26 | 0.08 | 0.23 | 0.91 | 0.006 | 0.002 | 0.25 | 0.78 | 0.32 | 0.62 | 0.002 |
| | 27 | 0.07 | 0.24 | 0.83 | 0.007 | 0.003 | 0.51 | 0.84 | 0.38 | 0.27 | 0.002 |
| | 28 | 0.07 | 0.28 | 0.86 | 0.006 | 0.001 | 0.23 | 0.82 | 0.29 | 0.31 | 0.001 |
| | 29 | 0.09 | 0.25 | 0.87 | 0.010 | 0.002 | 0.21 | 0.79 | 0.34 | 0.32 | 0.005 |
| | 30 | 0.10 | 0.23 | 0.93 | 0.006 | 0.002 | 0.24 | 0.86 | 0.35 | 0.28 | 0.001 |
| | 31 | 0.10 | 0.24 | 2.07 | 0.007 | 0.002 | 0.19 | 0.77 | 0.37 | 0.31 | 0.001 |
| | 32 | 0.09 | 0.23 | 0.92 | 0.008 | 0.003 | 0.26 | 0.83 | 0.31 | 0.25 | 0.001 |
| | 33 | 0.11 | 0.19 | 0.89 | 0.009 | 0.002 | 0.21 | 1.52 | 0.37 | 0.33 | 0.002 |
| | 34 | 0.09 | 0.31 | 0.85 | 0.008 | 0.002 | 0.22 | 0.87 | 0.36 | 0.31 | 0.002 |
| | 35 | 0.08 | 0.22 | 0.91 | 0.006 | 0.003 | 0.24 | 0.95 | 0.44 | 0.26 | 0.001 |
| | 36 | 0.11 | 0.27 | 0.86 | 0.007 | 0.002 | 0.18 | 0.92 | 0.37 | 0.37 | 0.002 |
| | 37 | 0.10 | 0.37 | 0.92 | 0.008 | 0.001 | 0.21 | 0.98 | 0.34 | 0.32 | 0.001 |
| | 38 | 0.09 | 0.18 | 0.85 | 0.009 | 0.003 | 0.23 | 0.79 | 0.42 | 0.29 | 0.001 |
| | 39 | 0.16 | 0.21 | 0.83 | 0.008 | 0.002 | 0.24 | 0.84 | 0.37 | 0.27 | 0.002 |
| | 40 | 0.08 | 0.20 | 0.87 | 0.009 | 0.002 | 0.19 | 0.86 | 0.36 | 0.32 | 0.001 |
| | 41 | 0.09 | 0.24 | 0.92 | 0.010 | 0.003 | 0.25 | 0.91 | 0.85 | 0.31 | 0.002 |
| | 42 | 0.10 | 0.21 | 0.86 | 0.006 | 0.002 | 0.22 | 0.88 | 0.36 | 0.34 | 0.002 |
| | 43 | 0.09 | 0.26 | 0.94 | 0.007 | 0.003 | 0.23 | 0.78 | 0.43 | 0.28 | 0.008 |
| | 44 | 0.08 | 0.22 | 0.91 | 0.007 | 0.003 | 0.18 | 0.93 | 0.39 | 0.33 | 0.001 |
| | 45 | 0.08 | 0.25 | 0.88 | 0.006 | 0.002 | 0.22 | 0.89 | 0.37 | 0.32 | 0.002 |

| | | Chemical compositions (mass %) | | | | | | | | |
|---|---|---|---|---|---|---|---|---|---|---|
| | | V | Ti | Al | B | N | BNP | Ca | REM | Ceq |
| INV. STEEL | 1 | 0.035 | 0.001 | 0.056 | 0.0013 | 0.0030 | 2.1 | 0 | 0 | 0.43 |
| | 2 | 0.037 | 0.001 | 0.064 | 0.0011 | 0.0028 | 2.3 | 0 | 0 | 0.49 |
| | 3 | 0.038 | 0.002 | 0.055 | 0.0009 | 0.0022 | 1.8 | 0 | 0 | 0.47 |
| | 4 | 0.007 | 0.001 | 0.061 | 0.0011 | 0.0033 | 2.7 | 0 | 0 | 0.43 |
| | 5 | 0.040 | 0.001 | 0.058 | 0.0010 | 0.0034 | 3.1 | 0.0016 | 0 | 0.45 |
| | 6 | 0.031 | 0.001 | 0.066 | 0.0009 | 0.0024 | 2.3 | 0 | 0 | 0.61 |
| | 7 | 0.030 | 0.001 | 0.059 | 0.0028 | 0.0047 | 1.6 | 0 | 0 | 0.42 |
| | 8 | 0.037 | 0.002 | 0.062 | 0.0014 | 0.0058 | 3.7 | 0 | 0 | 0.45 |
| | 9 | 0.035 | 0.001 | 0.065 | 0.0010 | 0.0035 | 3.2 | 0 | 0 | 0.48 |
| | 10 | 0.041 | 0.001 | 0.064 | 0.0013 | 0.0031 | 2.2 | 0 | 0.0033 | 0.42 |
| | 11 | 0.032 | 0.002 | 0.057 | 0.0010 | 0.0033 | 2.7 | 0 | 0 | 0.42 |
| | 12 | 0.033 | 0.001 | 0.063 | 0.0011 | 0.0029 | 2.4 | 0 | 0 | 0.42 |
| | 13 | 0.036 | 0.002 | 0.096 | 0.0009 | 0.0038 | 3.6 | 0 | 0 | 0.45 |
| | 14 | 0.038 | 0.001 | 0.062 | 0.0011 | 0.0032 | 2.6 | 0 | 0 | 0.51 |
| | 15 | 0.032 | 0.001 | 0.064 | 0.0005 | 0.0022 | 3.8 | 0 | 0 | 0.47 |
| | 16 | 0.059 | 0.001 | 0.059 | 0.0010 | 0.0034 | 3.1 | 0 | 0 | 0.44 |
| | 17 | 0.031 | 0.001 | 0.063 | 0.0012 | 0.0032 | 2.4 | 0 | 0 | 0.54 |
| | 18 | 0.034 | 0.001 | 0.028 | 0.0013 | 0.0033 | 2.3 | 0 | 0 | 0.47 |
| | 19 | 0.030 | 0.001 | 0.061 | 0.0012 | 0.0035 | 2.7 | 0 | 0 | 0.41 |
| | 20 | 0.035 | 0.002 | 0.058 | 0.0010 | 0.0034 | 2.8 | 0.0034 | 0 | 0.45 |
| | 21 | 0.033 | 0.001 | 0.062 | 0.0011 | 0.0031 | 2.6 | 0 | 0.0018 | 0.47 |
| | 22 | 0.037 | 0.001 | 0.064 | 0.0010 | 0.0030 | 2.7 | 0 | 0 | 0.44 |
| | 23 | 0.038 | 0.001 | 0.062 | 0.0011 | 0.0032 | 2.6 | 0 | 0 | 0.46 |
| | 24 | 0.040 | 0.001 | 0.068 | 0.0012 | 0.0035 | 2.7 | 0 | 0 | 0.51 |
| | 25 | 0.036 | 0.001 | 0.063 | 0.0011 | 0.0028 | 2.3 | 0 | 0 | 0.45 |
| COMP. STEEL | 26 | 0.033 | 0.001 | 0.059 | 0.0009 | 0.0033 | 3.3 | 0 | 0 | 0.49 |
| | 27 | 0.038 | 0.001 | 0.063 | 0.0011 | 0.0031 | 2.6 | 0 | 0 | 0.44 |
| | 28 | 0.042 | 0.001 | 0.061 | 0.0012 | 0.0051 | 4.0 | 0 | 0 | 0.41 |
| | 29 | 0.035 | 0.002 | 0.056 | 0.0011 | 0.0029 | 2.1 | 0 | 0 | 0.44 |
| | 30 | 0.066 | 0.001 | 0.063 | 0.0010 | 0.0035 | 3.2 | 0 | 0 | 0.47 |
| | 31 | 0.036 | 0.002 | 0.058 | 0.0011 | 0.0033 | 2.5 | 0 | 0 | 0.65 |
| | 32 | 0.032 | 0.001 | 0.064 | 0.0013 | 0.0030 | 2.1 | 0.0044 | 0 | 0.43 |
| | 33 | 0.044 | 0.001 | 0.063 | 0.0011 | 0.0034 | 2.8 | 0 | 0 | 0.52 |
| | 34 | 0.032 | 0.004 | 0.061 | 0.0010 | 0.0031 | 1.9 | 0 | 0 | 0.44 |
| | 35 | 0.033 | 0.001 | 0.057 | 0.0035 | 0.0033 | 0.9 | 0 | 0 | 0.46 |
| | 36 | 0.039 | 0.002 | 0.108 | 0.0008 | 0.0036 | 3.8 | 0 | 0 | 0.48 |
| | 37 | 0.041 | 0.001 | 0.062 | 0.0009 | 0.0033 | 3.3 | 0 | 0 | 0.47 |
| | 38 | 0.035 | 0.001 | 0.057 | 0.0012 | 0.0034 | 2.6 | 0 | 0.0051 | 0.45 |
| | 39 | 0.042 | 0.001 | 0.064 | 0.0011 | 0.0035 | 2.9 | 0 | 0 | 0.51 |
| | 40 | 0.036 | 0.001 | 0.059 | 0.0016 | 0.0064 | 3.8 | 0 | 0 | 0.44 |
| | 41 | 0.038 | 0.001 | 0.055 | 0.0010 | 0.0028 | 2.5 | 0 | 0 | 0.56 |
| | 42 | 0.043 | 0.001 | 0.063 | 0.0013 | 0.0022 | 1.5 | 0 | 0 | 0.47 |
| | 43 | 0.036 | 0.001 | 0.063 | 0.0012 | 0.0034 | 2.6 | 0 | 0 | 0.46 |
| | 44 | 0.039 | 0.008 | 0.061 | 0.0010 | 0.0050 | 2.7 | 0 | 0 | 0.46 |
| | 45 | 0.038 | 0.001 | 0.018 | 0.0012 | 0.0036 | 2.8 | 0 | 0 | 0.45 |

TABLE 2

| Steel | Plate thick. (mm) | Production condition: Reheat temp. (° C.) | Rolling end temp. (° C.) | Elapsed time from rolling to cooling start (s) | Cooling start temp. (° C.) | Cooling rate (° C./s) | Cooling stop temp. (° C.) | Tempering temp. (° C.) | Tempering time ((min) | |
|---|---|---|---|---|---|---|---|---|---|---|
| 1 a | 30 | 1100 | 895 | 33 | 863 | 15 | 187 | 620 | 30 | Inv. ex. |
| b | | 1100 | 891 | 8 | 881 | 15 | 176 | 620 | 30 | Comp. ex. |
| 2 a | 50 | 1130 | 889 | 45 | 875 | 12 | 194 | 640 | 20 | Inv. ex. |
| b | | 1130 | 876 | 84 | 837 | 12 | 185 | 640 | 20 | Comp. ex. |
| 3 a | 40 | 1150 | 886 | 36 | 869 | 11 | 186 | 600 | 20 | Inv. ex. |
| b | | 1150 | 884 | 38 | 866 | 11 | 221 | 600 | 20 | Comp. ex. |
| 4 a | 35 | 1050 | 893 | 31 | 865 | 16 | 156 | 620 | 30 | Inv. ex. |
| b | | 1050 | 891 | 30 | 864 | 16 | 166 | 680 | 30 | Comp. ex. |
| 5 a | 45 | 1130 | 884 | 43 | 871 | 10 | 164 | 640 | 40 | Inv. ex. |
| b | | 1000 | 885 | 44 | 869 | 10 | 153 | 640 | 40 | Comp. ex. |
| 6 a | 50 | 1200 | 890 | 87 | 874 | 6 | 178 | 620 | 30 | Inv. ex. |
| b | | 1200 | 892 | 49 | 883 | 6 | 168 | 400 | 30 | Comp. ex. |
| 7 a | 35 | 1080 | 896 | 38 | 861 | 15 | 162 | 640 | 20 | Inv. ex. |
| b | | 1080 | 893 | 35 | 862 | 3 | 171 | 640 | 20 | Comp. ex. |
| 8 a | 30 | 1100 | 899 | 37 | 864 | 17 | 191 | 650 | 30 | Inv. ex. |
| b | | 1100 | 862 | 15 | 841 | 17 | 167 | 650 | 30 | Comp. ex. |
| 9 a | 50 | 1130 | 886 | 51 | 876 | 9 | 187 | 640 | 30 | Inv. ex. |
| b | | 1130 | 884 | 53 | 875 | 2 | 191 | 640 | 30 | Comp. ex. |
| 10 a | 40 | 1100 | 887 | 44 | 868 | 12 | 183 | 600 | 20 | Inv. ex. |
| b | | 1100 | 885 | 96 | 841 | 12 | 172 | 600 | 20 | Comp. ex. |
| 11 a | 35 | 1150 | 883 | 39 | 862 | 14 | 154 | 620 | 30 | Inv. ex. |
| b | | 1150 | 863 | 38 | 840 | 14 | 161 | 620 | 30 | Comp. ex. |
| 12 a | 40 | 1080 | 884 | 46 | 872 | 9 | 156 | 640 | 40 | Inv. ex. |
| b | | 1080 | 872 | 81 | 829 | 9 | 153 | 640 | 40 | Comp. ex. |
| 13 a | 35 | 1100 | 894 | 41 | 859 | 12 | 136 | 640 | 30 | Inv. ex. |
| b | | 1100 | 874 | 76 | 833 | 12 | 152 | 640 | 30 | Comp. ex. |
| 14 a | 40 | 1150 | 890 | 43 | 869 | 14 | 185 | 640 | 20 | Inv. ex. |
| b | | 1150 | 890 | 40 | 867 | 4 | 172 | 640 | 20 | Comp. ex. |
| 15 a | 30 | 1200 | 901 | 34 | 863 | 13 | 176 | 620 | 30 | Inv. ex. |
| b | | 1200 | 926 | 113 | 870 | 13 | 183 | 620 | 30 | Comp. ex. |
| 16 a | 35 | 1130 | 896 | 33 | 866 | 10 | 192 | 620 | 30 | Inv. ex. |
| b | | 1130 | 893 | 36 | 865 | 10 | 177 | 620 | 90 | Comp. ex. |
| 17 a | 40 | 1100 | 888 | 41 | 873 | 12 | 168 | 600 | 20 | Inv. ex. |
| b | | 1100 | 889 | 40 | 870 | 12 | 156 | 600 | 5 | Comp. ex. |
| 18 a | 50 | 1100 | 879 | 52 | 868 | 11 | 173 | 640 | 30 | Inv. ex. |
| b | | 1250 | 882 | 55 | 865 | 11 | 179 | 640 | 30 | Comp. ex. |
| 19 a | 40 | 1130 | 883 | 40 | 870 | 10 | 188 | 620 | 40 | Inv. ex. |
| b | | 1130 | 880 | 43 | 869 | 10 | 233 | 620 | 40 | Comp. ex. |
| 20 a | 35 | 1150 | 895 | 36 | 864 | 14 | 183 | 620 | 20 | Inv. ex. |
| b | | 960 | 889 | 33 | 859 | 14 | 166 | 620 | 20 | Comp. ex. |
| 21 a | 30 | 1100 | 899 | 33 | 861 | 13 | 153 | 470 | 60 | Inv. ex. |
| b | | 1100 | 903 | 37 | 862 | 13 | 209 | 620 | 30 | Comp. ex. |
| 22 a | 30 | 1080 | 896 | 35 | 860 | 9 | 159 | 620 | 20 | Inv. ex. |
| b | | 1080 | 867 | 20 | 842 | 9 | 169 | 620 | 20 | Comp. ex. |
| 23 a | 50 | 1150 | 876 | 51 | 861 | 10 | 156 | 620 | 20 | Inv. ex. |
| b | | 1150 | 875 | 48 | 863 | 3 | 161 | 620 | 20 | Comp. ex. |
| 24 a | 80 | 1130 | 884 | 42 | 871 | 9 | 174 | 620 | 30 | Inv. ex. |
| b | | 1130 | 880 | 95 | 866 | 9 | 169 | 620 | 30 | Comp. ex. |
| 25 a | 100 | 1100 | 900 | 46 | 896 | 7 | 163 | 620 | 30 | Inv. ex. |
| b | | 1100 | 902 | 49 | 899 | 7 | 159 | 690 | 30 | Comp. ex. |

TABLE 3

| Steel | Plate thick. (mm) | Production condition: Reheat temp. (° C.) | Rolling end temp. (° C.) | Elapsed time from rolling to cooling start (s) | Cooling start temp. (° C.) | Cooling rate (° C./s) | Cooling stop temp. (° C.) | Tempering temp. (° C.) | Tempering time (min) | |
|---|---|---|---|---|---|---|---|---|---|---|
| 26 | 40 | 1130 | 886 | 41 | 869 | 11 | 196 | 620 | 30 | Comp. ex. |
| 27 | 35 | 1100 | 890 | 36 | 864 | 14 | 186 | 600 | 30 | Comp. ex. |
| 28 | 30 | 1150 | 891 | 35 | 862 | 15 | 191 | 620 | 20 | Comp. ex. |
| 29 | 30 | 1050 | 887 | 32 | 861 | 14 | 156 | 620 | 40 | Comp. ex. |
| 30 | 35 | 1080 | 893 | 37 | 865 | 12 | 178 | 620 | 20 | Comp. ex. |
| 31 | 50 | 1200 | 881 | 48 | 874 | 9 | 187 | 640 | 20 | Comp. ex. |
| 32 | 40 | 1200 | 885 | 44 | 868 | 12 | 153 | 620 | 30 | Comp. ex. |
| 33 | 45 | 1150 | 882 | 43 | 871 | 9 | 161 | 620 | 40 | Comp. ex. |
| 34 | 30 | 1150 | 886 | 36 | 863 | 17 | 173 | 640 | 30 | Comp. ex. |
| 35 | 35 | 1130 | 889 | 37 | 864 | 13 | 193 | 600 | 20 | Comp. ex. |

TABLE 3-continued

| Steel | Plate thick. (mm) | Production condition: Reheat temp. (° C.) | Rolling end temp. (° C.) | Elapsed time from rolling to cooling start (s) | Cooling start temp. (° C.) | Cooling rate (° C./s) | Cooling stop temp. (° C.) | Tempering temp. (° C.) | Tempering time (min) | |
|---|---|---|---|---|---|---|---|---|---|---|
| 36 | 50 | 1150 | 879 | 47 | 873 | 11 | 184 | 640 | 20 | Comp. ex. |
| 37 | 45 | 1100 | 886 | 41 | 869 | 11 | 165 | 640 | 40 | Comp. ex. |
| 38 | 35 | 1100 | 887 | 35 | 861 | 14 | 154 | 620 | 20 | Comp. ex. |
| 39 | 45 | 1200 | 883 | 45 | 870 | 13 | 197 | 620 | 30 | Comp. ex. |
| 40 | 30 | 1050 | 883 | 32 | 863 | 13 | 181 | 620 | 20 | Comp. ex. |
| 41 | 30 | 1080 | 886 | 36 | 862 | 12 | 159 | 640 | 20 | Comp. ex. |
| 42 | 35 | 1130 | 888 | 38 | 866 | 16 | 177 | 620 | 30 | Comp. ex. |
| 43 | 40 | 1150 | 884 | 43 | 868 | 10 | 163 | 640 | 20 | Comp. ex. |
| 44 | 45 | 1150 | 886 | 42 | 871 | 9 | 189 | 620 | 30 | Comp. ex. |
| 45 | 100 | 1130 | 897 | 55 | 894 | 7 | 162 | 620 | 30 | Comp. ex. |

TABLE 4

| Steel | Base material characteristics: ¼t Strength YS (MPa) | ¼t Strength TS (MPa) | ¼t Strength EL (%) | ¼t Toughness vE-40 (J) (Av) | ½t Strength YS (MPa) | ½t Strength TS (MPa) | ½t Strength EL (%) | ½t Toughness vE-40 (J) (Av) | Simulated HAZ characteristic (heat cycle test): Weld heat input (heat cycle test) (kJ/mm) | Toughness vE-40 (J) (Av) | |
|---|---|---|---|---|---|---|---|---|---|---|---|
| 1 a | 738 | 784 | 21 | 221 | 749 | 781 | 20 | 209 | 5 | 116 | Inv. ex. |
| b | 713 | 750 | 20 | 94 | 677 | 713 | 21 | 89 | 5 | 112 | Comp. ex. |
| 2 a | 841 | 883 | 22 | 223 | 799 | 839 | 21 | 206 | 5 | 130 | Inv. ex. |
| b | 677 | 720 | 21 | 90 | 643 | 684 | 22 | 86 | 5 | 126 | Comp. ex. |
| 3 a | 759 | 802 | 20 | 217 | 741 | 783 | 22 | 202 | 5 | 119 | Inv. ex. |
| b | 714 | 776 | 20 | 97 | 678 | 737 | 21 | 92 | 5 | 115 | Comp. ex. |
| 4 a | 738 | 783 | 21 | 221 | 725 | 781 | 22 | 208 | 5 | 116 | Inv. ex. |
| b | 653 | 718 | 20 | 90 | 621 | 682 | 21 | 85 | 5 | 112 | Comp. ex. |
| 5 a | 749 | 789 | 22 | 235 | 726 | 782 | 23 | 216 | 5 | 117 | Inv. ex. |
| b | 714 | 752 | 21 | 94 | 679 | 714 | 21 | 89 | 5 | 112 | Comp. ex. |
| 6 a | 821 | 876 | 19 | 191 | 780 | 832 | 22 | 175 | 5 | 130 | Inv. ex. |
| b | 876 | 903 | 17 | 90 | 832 | 858 | 22 | 86 | 5 | 135 | Comp. ex. |
| 7 a | 736 | 786 | 21 | 221 | 727 | 781 | 21 | 214 | 5 | 117 | Inv. ex. |
| b | 719 | 749 | 19 | 94 | 683 | 712 | 22 | 89 | 5 | 112 | Comp. ex. |
| 8 a | 756 | 803 | 22 | 238 | 736 | 789 | 23 | 221 | 5 | 119 | Inv. ex. |
| b | 747 | 786 | 20 | 98 | 709 | 747 | 22 | 93 | 5 | 117 | Comp. ex. |
| 9 a | 742 | 786 | 21 | 223 | 723 | 782 | 20 | 207 | 5 | 117 | Inv. ex. |
| b | 708 | 745 | 19 | 93 | 672 | 708 | 21 | 88 | 5 | 111 | Comp. ex. |
| 10 a | 734 | 783 | 20 | 210 | 721 | 781 | 21 | 204 | 5 | 117 | Inv. ex. |
| b | 716 | 762 | 20 | 95 | 680 | 724 | 20 | 90 | 5 | 114 | Comp. ex. |
| 11 a | 732 | 782 | 20 | 209 | 726 | 781 | 21 | 200 | 5 | 116 | Inv. ex. |
| b | 679 | 715 | 18 | 89 | 645 | 679 | 22 | 85 | 5 | 111 | Comp. ex. |
| 12 a | 741 | 785 | 21 | 222 | 719 | 782 | 22 | 209 | 5 | 117 | Inv. ex. |
| b | 711 | 741 | 20 | 93 | 676 | 704 | 21 | 88 | 5 | 111 | Comp. ex. |
| 13 a | 735 | 783 | 22 | 231 | 726 | 781 | 20 | 207 | 5 | 116 | Inv. ex. |
| b | 715 | 753 | 21 | 94 | 680 | 715 | 21 | 89 | 5 | 112 | Comp. ex. |
| 14 a | 951 | 994 | 18 | 197 | 903 | 944 | 23 | 169 | 5 | 147 | Inv. ex. |
| b | 868 | 914 | 20 | 91 | 825 | 868 | 22 | 87 | 5 | 135 | Comp. ex. |
| 15 a | 758 | 806 | 21 | 227 | 736 | 789 | 21 | 203 | 5 | 120 | Inv. ex. |
| b | 661 | 703 | 20 | 88 | 628 | 668 | 20 | 83 | 5 | 116 | Comp. ex. |
| 16 a | 724 | 781 | 22 | 228 | 716 | 780 | 21 | 215 | 5 | 116 | Inv. ex. |
| b | 682 | 726 | 21 | 91 | 648 | 690 | 20 | 86 | 5 | 112 | Comp. ex. |
| 17 a | 805 | 851 | 21 | 242 | 765 | 808 | 23 | 233 | 5 | 126 | Inv. ex. |
| b | 828 | 845 | 20 | 94 | 787 | 803 | 21 | 89 | 5 | 126 | Comp. ex. |
| 18 a | 809 | 849 | 22 | 254 | 703 | 781 | 22 | 137 | 5 | 126 | Inv. ex. |
| b | 802 | 862 | 21 | 96 | 762 | 819 | 21 | 91 | 5 | 128 | Comp. ex. |
| 19 a | 748 | 787 | 20 | 214 | 725 | 782 | 20 | 207 | 5 | 117 | Inv. ex. |
| b | 717 | 763 | 20 | 95 | 681 | 725 | 21 | 91 | 5 | 114 | Comp. ex. |
| 20 a | 731 | 784 | 20 | 209 | 721 | 781 | 23 | 198 | 5 | 117 | Inv. ex. |
| b | 666 | 701 | 21 | 88 | 633 | 666 | 22 | 83 | 5 | 111 | Comp. ex. |
| 21 a | 868 | 916 | 21 | 228 | 825 | 870 | 20 | 206 | 5 | 135 | Inv. ex. |
| b | 852 | 888 | 19 | 89 | 810 | 844 | 21 | 84 | 5 | 132 | Comp. ex. |
| 22 a | 734 | 783 | 22 | 231 | 719 | 781 | 20 | 205 | 5 | 116 | Inv. ex. |
| b | 688 | 724 | 21 | 91 | 653 | 688 | 21 | 86 | 5 | 111 | Comp. ex. |
| 23 a | 799 | 837 | 20 | 228 | 759 | 795 | 20 | 217 | 5 | 124 | Inv. ex. |
| b | 721 | 766 | 21 | 96 | 685 | 728 | 22 | 91 | 5 | 114 | Comp. ex. |

TABLE 4-continued

| | Base material characteristics | | | | | | | | Simulated HAZ characteristic (heat cycle test) | | |
|---|---|---|---|---|---|---|---|---|---|---|---|
| | ¼t | | | | ½t | | | | Weld heat input | | |
| | Strength | | | Toughness | Strength | | | Toughness | (heat | Toughness | |
| Steel | YS (MPa) | TS (MPa) | EL (%) | vE-40 (J) (Av) | YS (MPa) | TS (MPa) | EL (%) | vE-40 (J) (Av) | cycle test) (kJ/mm) | vE-40 (J) (Av) | |
| 24 a | 769 | 801 | 21 | 231 | 745 | 790 | 21 | 222 | 5 | 119 | Inv. ex. |
| b | 743 | 771 | 22 | 96 | 706 | 732 | 21 | 92 | 5 | 115 | Comp. ex. |
| 25 a | 753 | 787 | 20 | 215 | 722 | 782 | 21 | 205 | 5 | 117 | Inv. ex. |
| b | 707 | 756 | 21 | 95 | 672 | 718 | 20 | 90 | 5 | 112 | Comp. ex. |

TABLE 5

| | Base material characteristics | | | | | | | | Simulated HAZ characteristic | | |
|---|---|---|---|---|---|---|---|---|---|---|---|
| | ¼t | | | | ½t | | | | (heat cycle test) | | |
| | Strength | | | Toughness | Strength | | | Toughness | Weld heat input | Toughness | |
| Steel | YS (MPa) | TS (MPa) | EL (%) | vE-40 (J) (Av) | YS (MPa) | TS (MPa) | EL (%) | vE-40 (J) (Av84) | (heat cycle (kJ/mm) | vE-40 (J) (Av) | |
| 26 | 772 | 816 | 18 | 96 | 723 | 775 | 19 | 96 | 5 | 34 | Comp. ex. |
| 27 | 715 | 757 | 20 | 99 | 679 | 719 | 18 | 84 | 5 | 27 | Comp. ex. |
| 28 | 683 | 727 | 21 | 99 | 649 | 691 | 20 | 89 | 5 | 24 | Comp. ex. |
| 29 | 757 | 805 | 18 | 94 | 719 | 765 | 20 | 99 | 5 | 34 | Comp. ex. |
| 30 | 804 | 851 | 22 | 98 | 764 | 808 | 21 | 89 | 5 | 28 | Comp. ex. |
| 31 | 815 | 850 | 21 | 95 | 774 | 808 | 20 | 86 | 5 | 29 | Comp. ex. |
| 32 | 745 | 787 | 11 | 57 | 708 | 748 | 19 | 93 | 5 | 40 | Comp. ex. |
| 33 | 848 | 893 | 20 | 94 | 806 | 848 | 20 | 90 | 5 | 33 | Comp. ex. |
| 34 | 764 | 812 | 20 | 85 | 726 | 771 | 20 | 81 | 5 | 30 | Comp. ex. |
| 35 | 760 | 803 | 21 | 89 | 722 | 763 | 21 | 84 | 5 | 27 | Comp. ex. |
| 36 | 836 | 879 | 19 | 88 | 795 | 835 | 20 | 88 | 5 | 35 | Comp. ex. |
| 37 | 818 | 862 | 20 | 91 | 777 | 819 | 18 | 78 | 5 | 32 | Comp. ex. |
| 38 | 750 | 794 | 12 | 62 | 713 | 754 | 19 | 93 | 5 | 47 | Comp. ex. |
| 39 | 985 | 1036 | 18 | 99 | 936 | 984 | 18 | 94 | 5 | 46 | Comp. ex. |
| 40 | 724 | 770 | 19 | 95 | 688 | 723 | 21 | 99 | 5 | 29 | Comp. ex. |
| 41 | 803 | 853 | 21 | 94 | 763 | 810 | 20 | 85 | 5 | 30 | Comp. ex. |
| 42 | 802 | 849 | 20 | 89 | 762 | 807 | 18 | 76 | 5 | 31 | Comp. ex. |
| 43 | 775 | 819 | 18 | 96 | 736 | 778 | 19 | 96 | 5 | 34 | Comp. ex. |
| 44 | 732 | 770 | 20 | 81 | 695 | 732 | 21 | 81 | 5 | 27 | Comp. ex. |
| 45 | 664 | 707 | 19 | 70 | 631 | 672 | 21 | 74 | 5 | 26 | Comp. ex. |

INDUSTRIAL APPLICABILITY

According to the present invention, the remarkable effects are exhibited that it is possible to produce high strength steel plate provided with both base material low temperature toughness and HAZ low temperature toughness which is Nb-free and Ti-free, has a 780 MPa class strength, and has excellent low temperature toughnesses of the base material and HAZ, that is, a low temperature toughness vE-40 of the base material of 100 J or more and a low temperature toughness vE-40 of the of HAZ of 50 J or more and it is possible to apply this to thick-gauge steel plate for offshore structures, penstocks, etc.

The invention claimed is:

1. A method of production of 780 MPa class high strength steel plate superior in low temperature toughness characterized by heating a steel slab of chemical ingredients containing, by mass %, C: 0.06 to 0.15%, Si: 0.05 to 0.35%, Mn: 0.60 to 2.00%, P: 0.015% or less, S: 0.015% or less, Cu: 0.1 to 0.5%, Ni: 0.1 to 1.5%, Cr: 0.05 to 0.8%, Mo: 0.05 to 0.6%, Nb: less than 0.005%, V: 0.005 to 0.060%, Ti: less than 0.003%, Al: 0.02 to 0.10%, B: 0.0005 to 0.003%, and N: 0.002 to 0.006%, having a balance of iron and unavoidable impurities, having a Ceq defined by the equation (1) of 0.41 to 0.61, having a BNP defined by the equation (2) of over 1.5 to less than 4.0, to 1050° C. to 1200° C. in temperature, hot rolling ending at 870° C. to 901° C., waiting for 31 seconds to 90 seconds, then cooling from 840° C. or more in temperature by a 5° C./s or more cooling speed to 200° C., then tempering at 450° C. to 650° C. in temperature for 20 minutes to 60 minutes, $$Ceq = \%C + \%Mn/6 + (\%Cu + \%Ni)/15 + (\%Cr + \%Mo + \%V)/5 \quad \text{equation (1)}$$

$$BNP = (N - (14/48)Ti)/B \quad \text{equation (2).}$$

2. A method of production of 780 MPa class high strength steel plate superior in low temperature toughness as set forth in claim 1, characterized in that said steel slab further contains, by mass %, one or more of Ca: 0.0035% or less and
REM: 0.0040% or less.

* * * * *